US007878318B2

(12) United States Patent
Nunn et al.

(10) Patent No.: US 7,878,318 B2
(45) Date of Patent: Feb. 1, 2011

(54) CASSETTE FOR STORING BILLS AND THE LIKE

(75) Inventors: Michael D. Nunn, West Chester, PA (US); André Gerlier, Sciez (FR); Richard Mathis, Gex (FR)

(73) Assignee: MEI, Inc., West Chester, PA (US)

( * ) Notice: Subject to any disclaimer, the term of this patent is extended or adjusted under 35 U.S.C. 154(b) by 232 days.

(21) Appl. No.: 11/492,585

(22) Filed: Jul. 25, 2006

(65) Prior Publication Data

US 2007/0023255 A1 Feb. 1, 2007

Related U.S. Application Data

(60) Provisional application No. 60/703,072, filed on Jul. 27, 2005.

(51) Int. Cl.
*G07F 9/10* (2006.01)
*B65H 1/00* (2006.01)

(52) U.S. Cl. ..... 194/350; 271/145

(58) Field of Classification Search ..... 194/206, 194/207, 350; 235/1 A, 23, 24; 902/9–17; 232/15, 16; 271/176, 215, 9.03, 145; 221/6, 221/287, 197, 198; 414/411, 414; 220/345.1, 220/345.2, 345.3, 351
See application file for complete search history.

(56) References Cited

U.S. PATENT DOCUMENTS 1,776,331 A * 9/1930 Lee ..... 74/127
3,919,890 A * 11/1975 Workman ..... 74/89
4,377,228 A * 3/1983 Ostermann ..... 194/251
4,659,008 A * 4/1987 Howett et al. ..... 232/43.3
4,977,583 A * 12/1990 Gorgone ..... 377/8
5,126,789 A * 6/1992 Fukuchi et al. ..... 399/18
5,328,169 A * 7/1994 Mandel ..... 271/290
5,480,131 A * 1/1996 Furukawa et al. ..... 271/9.06
5,501,633 A * 3/1996 Watkins et al. ..... 453/17
5,538,122 A 7/1996 Siemens
5,616,915 A 4/1997 Simpkins et al.
5,715,923 A * 2/1998 Dekker et al. ..... 194/206
5,842,694 A * 12/1998 Brooks et al. ..... 271/38
5,887,695 A * 3/1999 Hatamachi et al. ..... 194/207
5,988,345 A * 11/1999 Bergeron et al. ..... 194/203
6,345,727 B1 * 2/2002 Kazou ..... 221/145
6,712,352 B2 3/2004 Bergeron et al.
6,948,607 B2 * 9/2005 Ito et al. ..... 194/206
7,172,111 B2 * 2/2007 Yoshioka et al. ..... 232/15
7,186,176 B2 * 3/2007 Umeda ..... 453/29
2004/0149817 A1 8/2004 Kuroiwa et al.
2004/0195302 A1 10/2004 Washington et al.

* cited by examiner

*Primary Examiner*—Stefanos Karmis
*Assistant Examiner*—Mark J Beauchaine
(74) *Attorney, Agent, or Firm*—Fish & Richardson P.C.

(57) ABSTRACT

A cassette for storing bills is described. The cassette includes a shutter, a link which engages the shutter; and a helicoidal drive shaft which engages the link. As the cassette is inserted or removed from a chassis, an actuator fixed to the chassis actuates the drive shaft such that the shutter opens or closes. In some embodiments, the cassette may prevent persons without proper authorization from accessing bills inside the cassette.

40 Claims, 14 Drawing Sheets

CASSETTE FOR STORING BILLS AND THE LIKE

CROSS-REFERENCE TO RELATED APPLICATION(S)

This application claims priority from U.S. Provisional Application 60/703,072 filed on Jul. 27, 2005, the disclosure of which is incorporated herein by reference.

BACKGROUND

Modular bill handling systems can process, check, store and dispense currency items such as bills. These systems can include a main module (e.g., a validating unit) and a spine chassis in which storage units can be attached. Bills accepted and processed by the bill handling system may be stored in the storage units. Periodically, servicemen may remove the storage module to a cash-room in order to empty the module of bills. In some cases, it may be necessary to ensure the security of the storage module so that the bills cannot be accessed improperly or without authorization.

The following disclosure relates to a type of storage module, for example, a lockable and removable cassette, that stores bills in a modular bill handling system.

SUMMARY

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
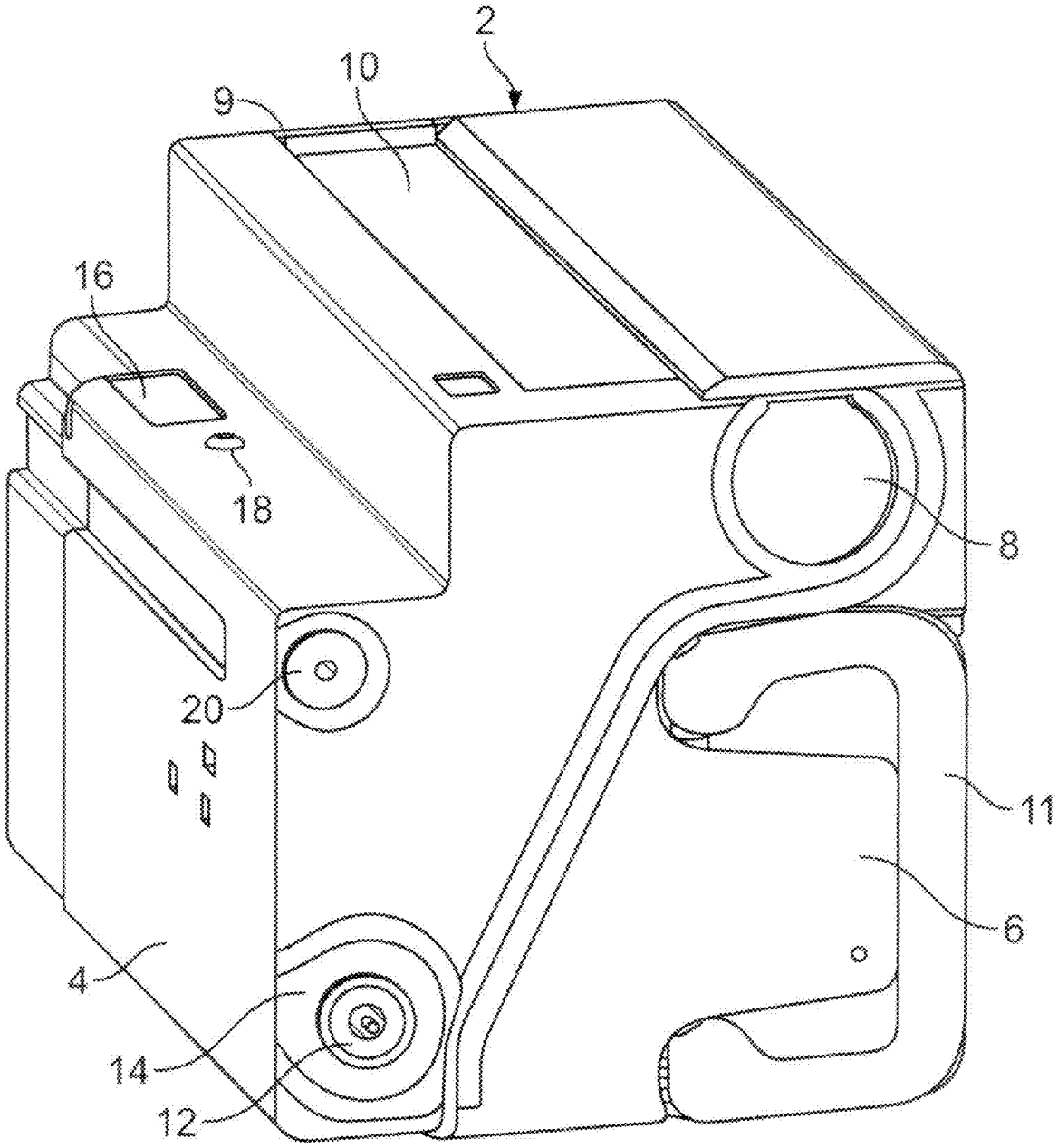
FIG. 1 is an external view of a cashbox.
Figure 1B:
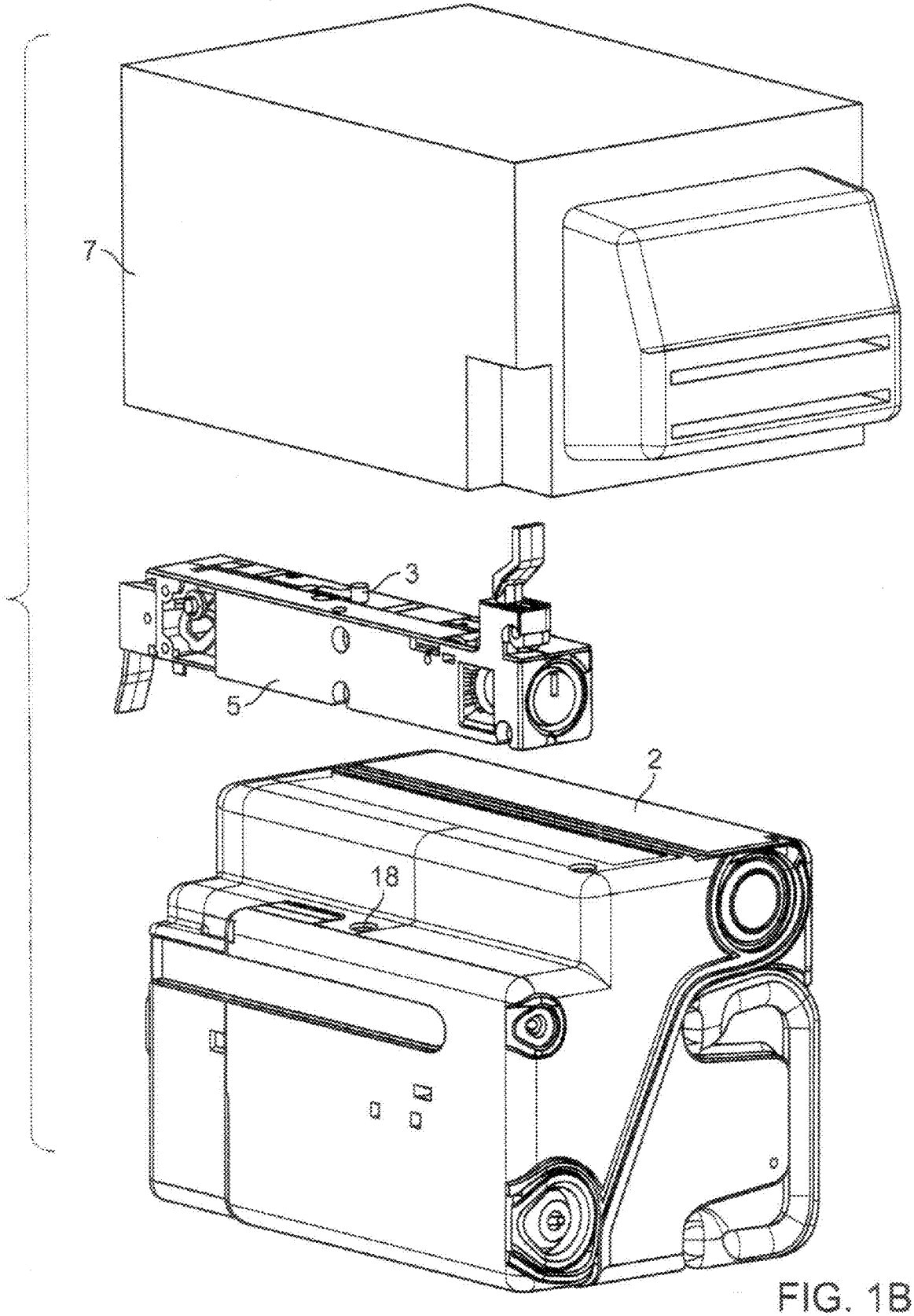

FIG. 1A shows an example of a lockable cassette, also known as a cashbox 2, which may be placed in a modular bill handling system. The cashbox 2 functions as a cassette which accepts and stores bills received by a main chassis such as a validating unit (not shown in the figure). The modular design of the cashbox 2 allows it to be inserted or removed from a chamber located in the main chassis. As shown in the example of FIG. 1, the outer shell of the cashbox 2 may be composed of a body 4 and door 6 that are connected by a hinge 8 located in the upper corner of the cashbox. The hinge 8 allows the door 6 to swing open from the body so that a user may access bills contained within the cashbox 2. The door 6 includes a folding handle 11 which facilitates insertion, removal and transportation of the cashbox 2. When the cashbox 2 is inserted into the chassis chamber, the folding handle 11 preferably is located on the front, i.e., the user accessible side of the cashbox 2.

The top face of the cashbox 2 includes a rectangular aperture 9 through which bills are inserted. A separate bill acceptor module 7 (see FIG. 1B) provided in the chassis and located above the cashbox 2, uses a rectangular "push plate" (not shown) to push the bills through the open aperture 9 and into the cashbox 2 onto a pressure plate or "stacker." In order to prevent access to bills contained within the cashbox during transport, the aperture 9 may be closed using a shutter 10. The shutter 10 can be opened by a drive shaft actuator which is fixed within the chassis. In order to open the shutter, the actuator engages a drive shaft accessible on the rear face of the cashbox 2 as the cashbox is inserted into the chamber. When the cashbox 2 is removed from the chamber, the actuator may reverse the drive shaft so that the shutter closes. This feature ensures that the top of the cashbox 2 is closed every time the cashbox is removed from the chassis, so that any bills contained within cashbox 2 cannot be accessed through aperture 9. A more detailed discussion of the drive shaft actuator operation is provided further below. The shutter 10 may be positioned in a third "retracted" state, as well. The "retracted" state of the shutter 10 can occur when the cashbox 2 is unlocked and the door 6 is opened. In this position, the shutter may move into a recess of the cashbox molding such that door 6 does not hit the shutter 10. In some implementations, the shutter 10 may be formed of plastic. In other implementations, the shutter 10 may be formed of metal.

The outer shell of the cashbox 2 further includes a lock 12 retained by a lock bracket 14. The lock 12 can secure the door 6 to the body 4 so as to prevent unauthorized access to the cashbox interior. Since both the lock bracket 14 and folding handle 11 are human interaction features on the cashbox 2, they are preferably colored so as to distinguish them from other components on the cashbox 2. The lock bracket 14 may, for example, enable customer-specified locks to be assembled on the exterior of the cashbox 2 without the use of special tools.

A window 16 arranged on a side of the cashbox 2 can be used to pass light beams (not shown) provided by the main chassis to prisms located within the cashbox 2. If the cashbox 2 is in the correct position within the chassis, a first light beam directed to a first prism located in the cashbox will be deflected back out towards a first light sensor within the chassis. Should the first light sensor detect the first light beam, the bill handling system may determine that the cashbox 2 is present. A second light beam directed to a second prism located in the cashbox is also deflected out of the cashbox 2 towards a second light sensor. The second prism is used to determine the bill capacity of the cashbox 2. The operation of the first and second prisms will be described below.

The cashbox 2 also includes an interface peg 18 that may assist in removing the bill acceptor module 7 in case of a jam. When the cashbox 2 is positioned in the chassis, a pin 3 formed in a locking module 5 and interfacing with the bill acceptor module 7 sits on top of an interface peg 18 (see FIG. 1B). The pin 3 of the locking module 5 goes into a recess on the underside of the bill acceptor module 7 so that unless the pin is able to move downwards into the cashbox volume then the acceptor head is unable to be removed. The pin from the bill acceptor module 7 probes the interface peg 18 to determine a state of the peg 18. If the peg 18 is secured, such that the pin does not depress the peg, the bill acceptor module 7 remains locked. If the peg 18 is unsecured, such that the pin can depress the peg 18 or fall into a void, the bill acceptor module 7 unlocks and can be removed from the bill handling system. Unlocking the door 6 allows peg 18 to be in an unsecured state so that it may be depressed by the bill acceptor module 7 pin while locking door 6 secures peg 18 such that it may not be depressed by the pin. The retractable interface peg feature allows users with proper access (i.e., those who are in possession of a cashbox access key) to remove the bill acceptor module 7 in case the system jams with the "push plate" extended in the cashbox 2.

Figure 5:
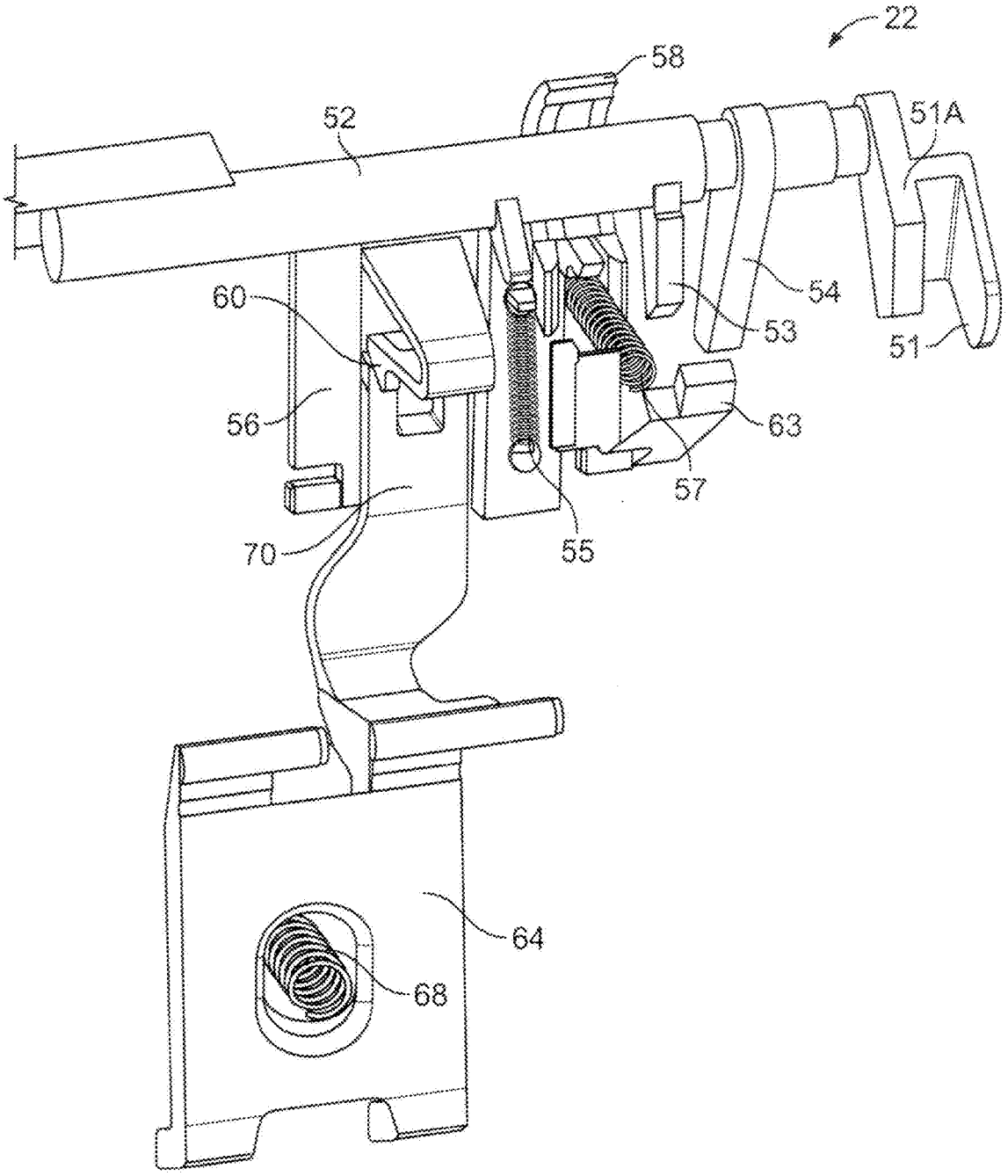
FIG. 5 shows internal cashbox components used in a shutter arming mechanism.

An aperture 20 located on the front face of body 4 indicates the "arming state" of a shutter arming mechanism 22 (see FIG. 5) provided within the cashbox 2. The shutter arming mechanism 22 ensures the shutter 10 is only able to open at the appropriate times in the functional cycle of the cashbox so as to meet the required security of the overall system. The two states of the shutter arming mechanism 22 are either "armed" or "disarmed." When the shutter arming mechanism 22 is "armed," the cashbox 2 may be inserted and removed into the chamber of the chassis without the shutter 10 becoming locked. When the shutter arming mechanism 22 is "disarmed" by activation of the "stacker," the shutter 10 locks after closing such that it cannot be reopened unless the shutter arming mechanism 22 is reset by action of unlocking and opening the cashbox 2. A fluorescent indicator may be visible in aperture 20 when the shutter arming mechanism 22 is in the "armed" state. Further details of the shutter arming mechanism 22 operation are discussed further below.

In a particular embodiment, the cashbox 2 may be used as follows: 1) an empty and locked cashbox 2 having shutter arming mechanism 22 in the "armed" state is inserted into a chamber of the bill handling system chassis; 2) as the cashbox 2 is inserted into the chassis, the drive shaft actuator opens shutter 10; 3) as bills are accepted by the bill handling system, the bill handling module pushes the accepted bills into the cashbox 2 by use of a "push plate" which operates a stacker contained within cashbox 2; 4) the shutter arming mechanism 22 is "disarmed" by operation of the stacker; 5) shutter 10 is closed by the drive shaft actuator as the cashbox 2 is removed from the chassis; 6) shutter 10 cannot be opened as it is locked by shutter arming mechanism 22; 7) lock 12 on cashbox 2 is unlocked and door 6 is opened which resets the shutter arming mechanism 22 to the "armed" state; 8) the cashbox 2 may be emptied of bills and locked again such that it is ready to be re-inserted into a bill handling system.

Shutter Operation

Figure 2:
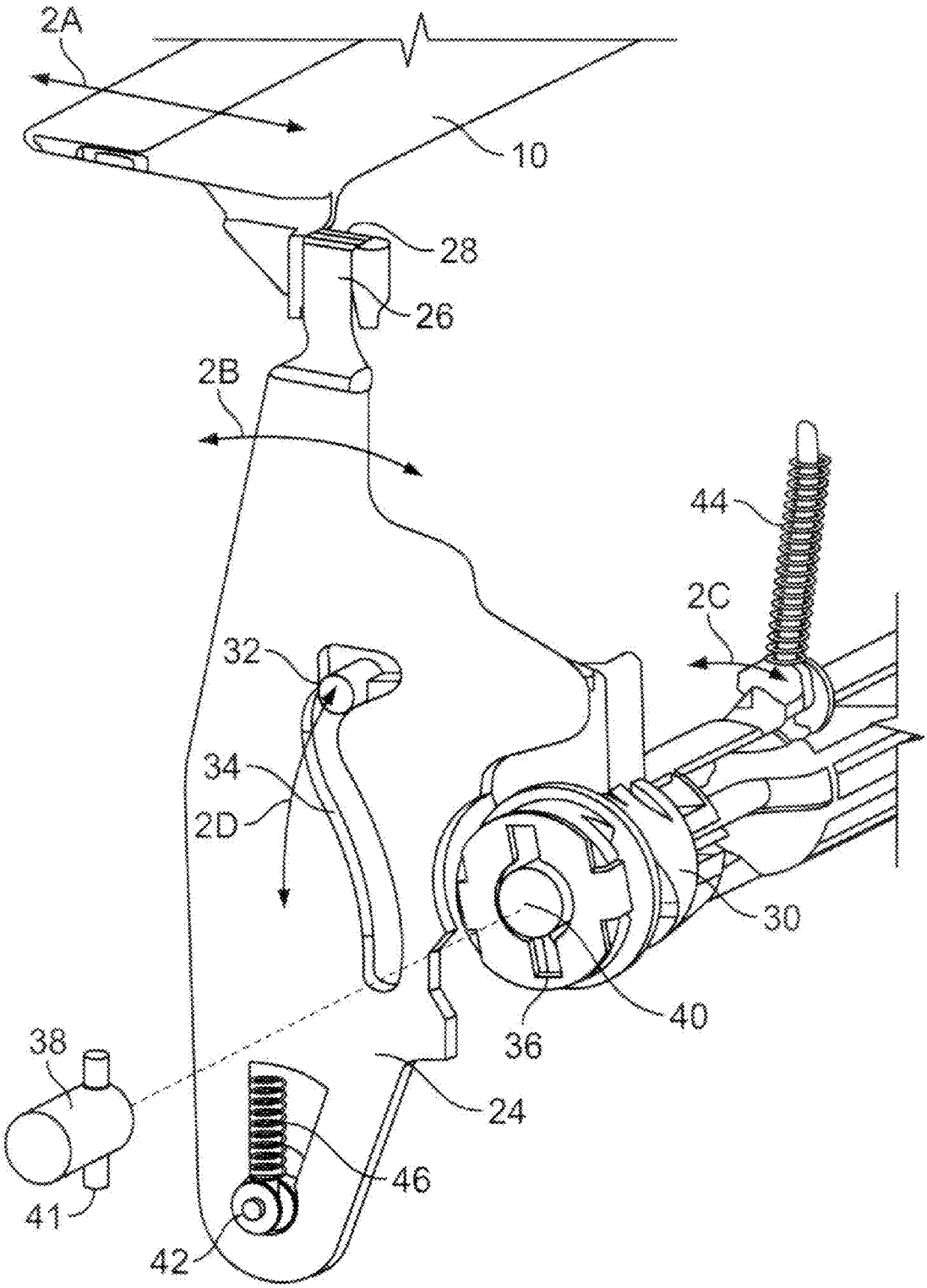
FIG. 2 shows internal cashbox components used in operating a shutter.
Figure 3:
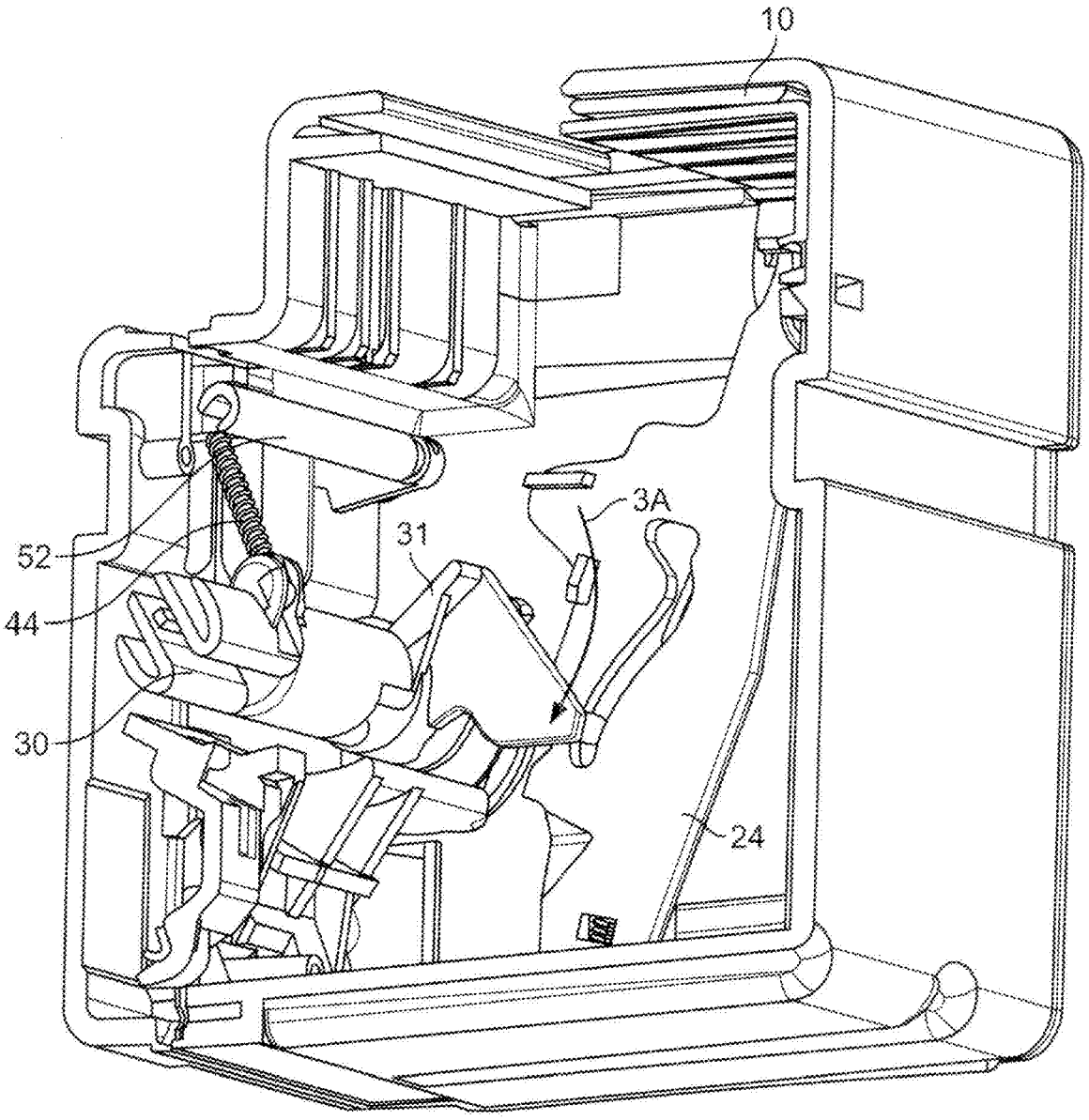
FIG. 3 is an internal view of a cashbox.
Figure 4A:
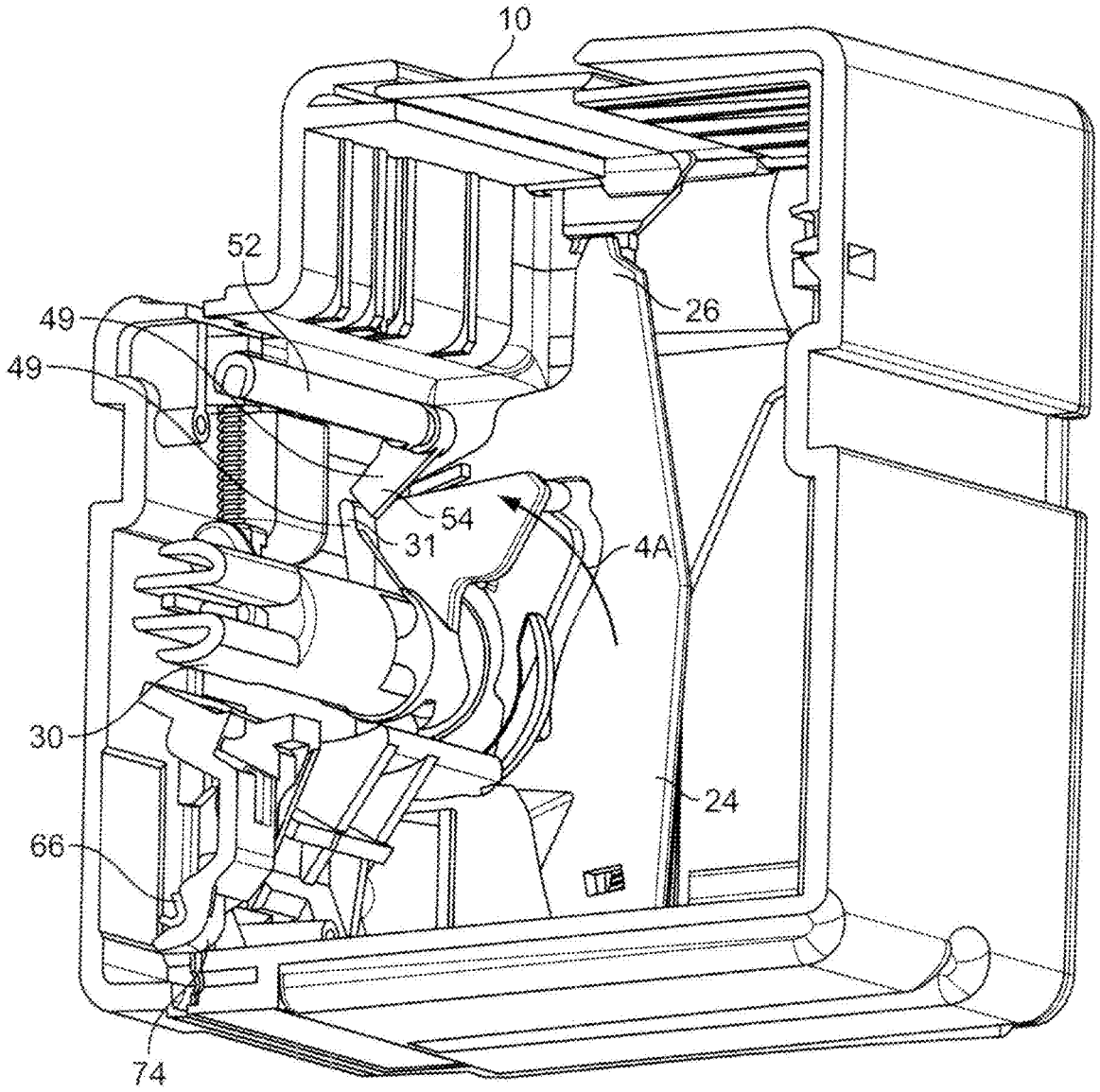
FIG. 4A is an internal view of a cashbox.

Internal cashbox components used in opening shutter 10 are shown in FIG. 2. Internal cashbox views of the shutter 10 in opened and closed positions are shown in FIGS. 3 and 4A. The shutter 10 may be moved between the opened and closed positions by means of two pivoted links 24 located near the front and back inner walls of the cashbox 2 (see FIG. 2). Link tips 26 at the top of each link 24 are positioned in slots 28 formed on the sides of shutter 10. As the links 24 move back and forth (indicated by arrows 2B in FIG. 2), link tips 26 push the shutter 10 open and closed (arrows 2A). The links 24 are actuated using a rotating drive shaft 30 which has side pins 32 that engage slots 34 of the links 24. The end of the drive shaft 30 includes a helical slot 36 for receiving a cylindrical shaft actuator 38 which is fixed within the chassis. The shaft actuator 38 is concentric with both helical slot 36 and drive shaft pivot 40 of the drive shaft 30. A pin 41 protrudes from the end of shaft actuator 38. In some implementations, the shaft actuator 38 and pin 41 are formed of steel.

As the cashbox is inserted into the chamber of the chassis, shaft actuator 38 engages the helical slot 36 of the drive shaft 30 through an opening in the back face of the cashbox 2. Accordingly, the drive shaft 30 rotates (arrows 2C) and, in turn, moves side pins 32 through slots 34 (arrows 2D). The motion of side pins 32 through slots 34 forces links 24 to rotate about link pivots 42 so that link tips 26 push the shutter open. Link springs 46 can provide a tension force which assists returning links 24 to their lower position as the shutter 10 is opened. An example of a shutter "opened" position is shown in FIG. 3. Halfway through insertion of cashbox 2 into the chamber, an over-center spring 44 connected to drive shaft 30 provides an expansion force in a direction that assists the rotation of drive shaft 30. As a result of this additional force applied to the rotation of drive shaft 30, the cashbox 2 appears to be "pulled" into the chamber.

Upon removing the cashbox 2 from the chassis, the drive shaft 30 rotates in the opposite direction such that the shutter 10 closes. Just as in the case of insertion, the over-center spring 44 provides a force, halfway through removal of the cashbox 2, that assists rotation of the drive shaft 30 and effectively "pushes" the cashbox 2 out of the chamber. An example of a shutter "closed" position is shown in FIG. 4A. Preferably, the helical slot 36 of the drive shaft 30 is designed so that, during withdrawal, the shutter 10 is completely closed before any part of the aperture 9 at the top face of the cashbox is visible outside the chassis.

Figure 4B:
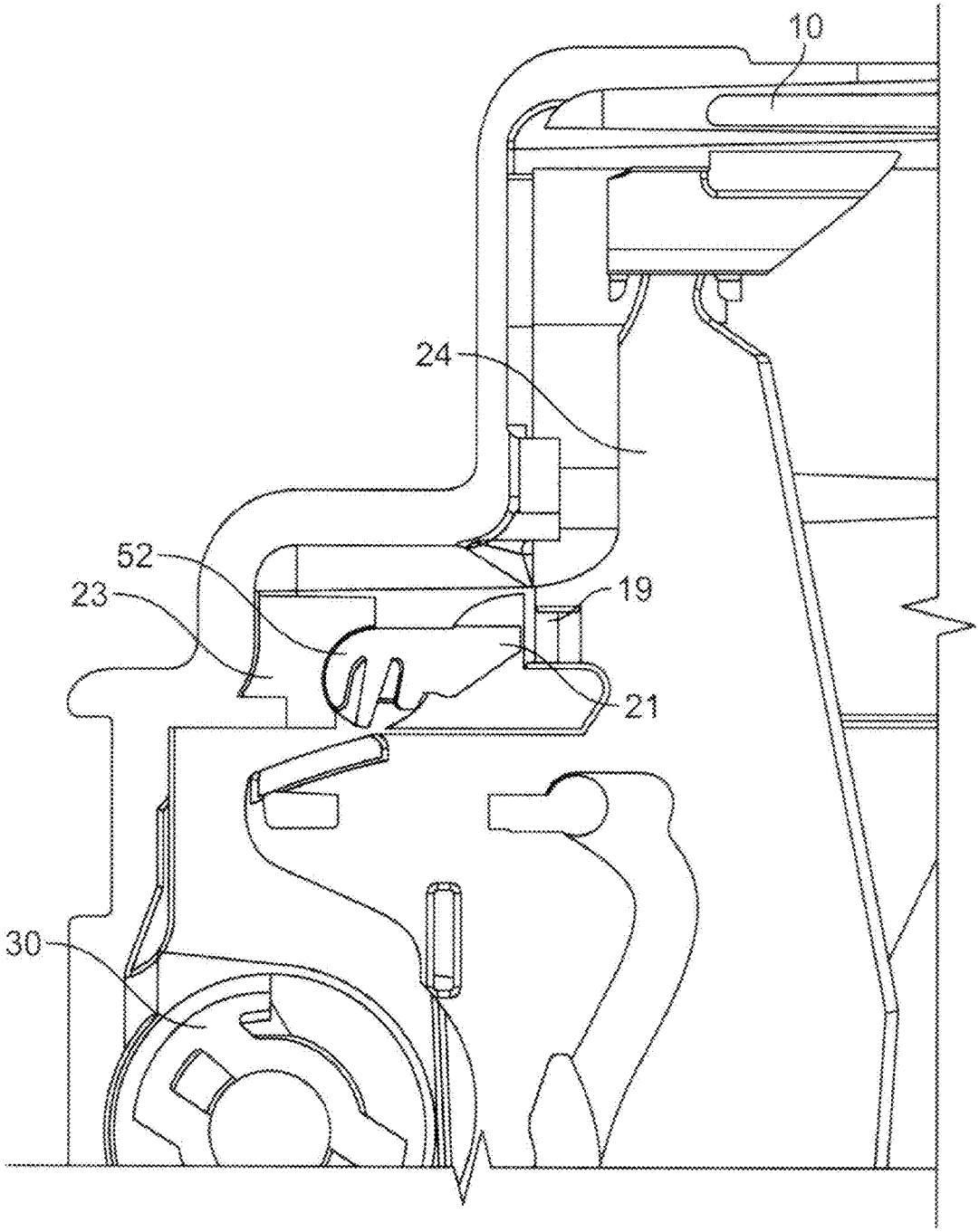
FIG. 4B shows internal cashbox components used in operating a shutter.

The cashbox 2 includes security mechanisms which can prevent forcing shutter 10 open when the shutter is in the closed position. FIG. 4B shows a partial internal side view of the cashbox 2 when shutter 10 is closed. If, for example, an attempt is made to force shutter 10 to the left in FIG. 4B, link 24 will also move to the left. In this case, a stop peg 19 formed on link 24 hits a stop strut 21 formed on first latch 52 such that the link 24 cannot continue to move to the left. Consequently, shutter 10 cannot move to the left and the cashbox 2 may remain inaccessible through the aperture 9. The first latch 52 also can be buffered by a stop rib 23 formed on the cashbox molding. First latch 52 is a component of the shutter arming mechanism 22 to be discussed further below.

Figure 4C:
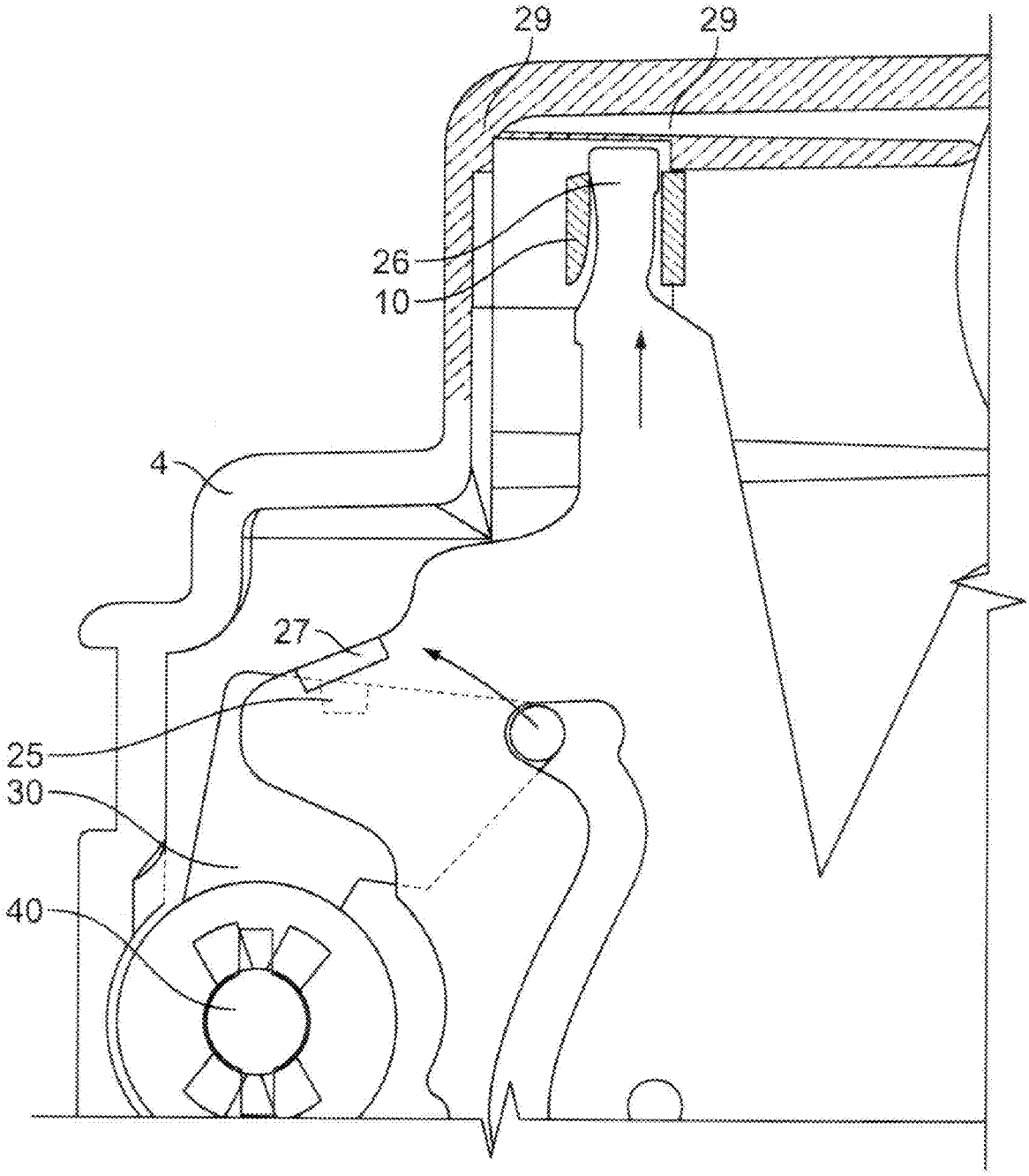
FIG. 4C shows internal cashbox components used in operating a shutter.

Alternatively, if an attempt is made to force shutter 10 to the right, this motion can also be blocked. FIG. 4C shows an alternative internal side view of the cashbox 2. When the drive shaft 30 reaches the top of its rotation, cams 25 on the outer surfaces of drive shaft 30 lift ribs 27 on the inner surfaces of links 24. This causes link tips 26 to rise into recesses 29 in the cashbox molding. In this position, it is not possible for the shutter 10 to be moved in a rightward direction from outside the cashbox 2. Therefore, the cashbox 2 prevents exploitation of the shutter mechanism by providing a hard stop.

Pressure Plate

Figure 6:
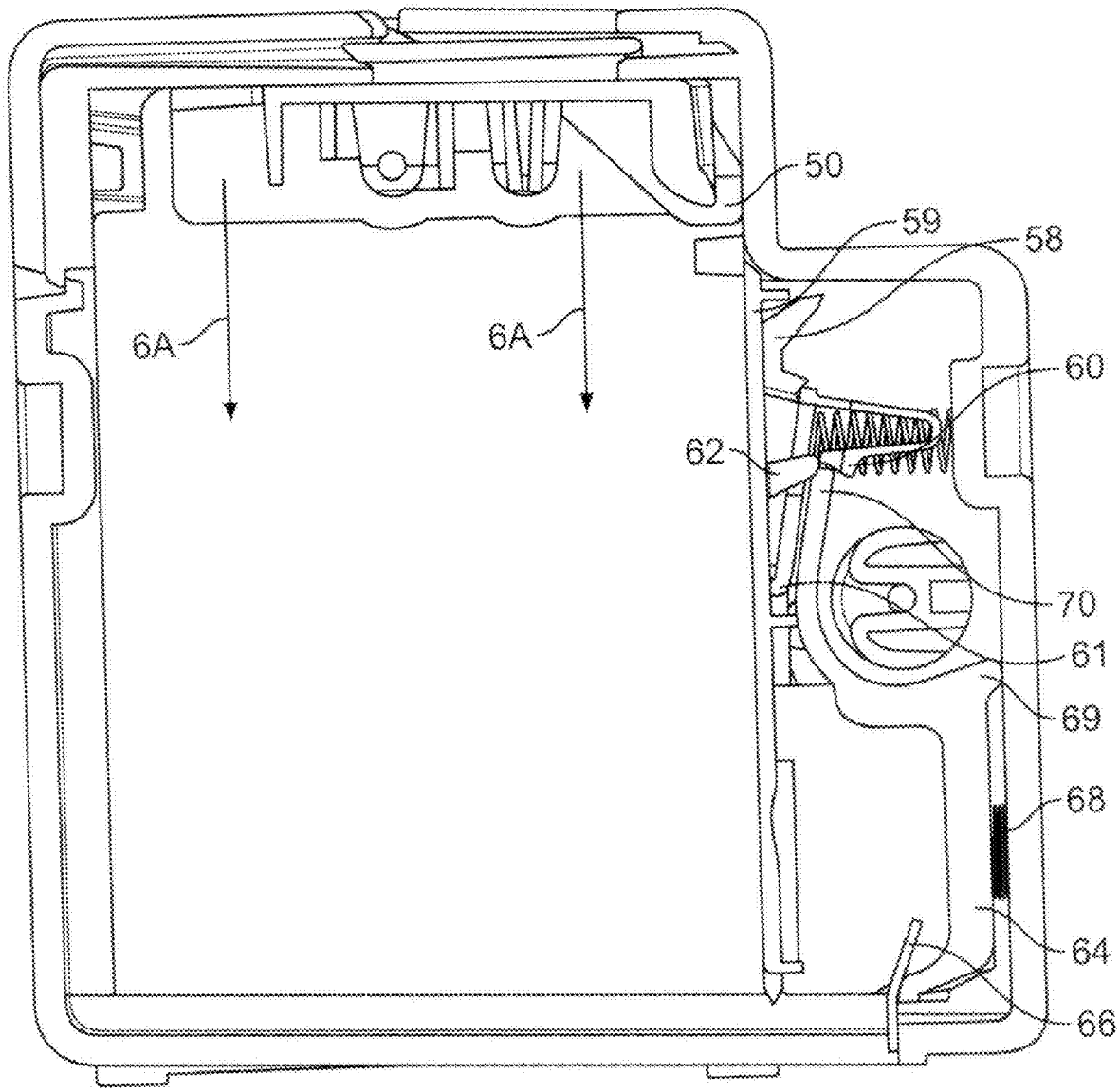
FIG. 6 is an internal side view of a cashbox.

Below the shutter 10 is a pressure plate 50 or "stacker" (see FIG. 6) which holds bills at the top of the cashbox 2 as they are inserted by the rectangular "push plate" of the bill acceptor module 7. The force of the "push plate" against pressure plate 50 moves the plate 50 downward in the direction of arrows 6A and compresses a spring (not shown) located beneath the pressure plate 50. As the "push plate" is removed after insertion of the bill, the restoring force of the spring applies a pressure to plate 50 to force the plate back up and secure the bills against the top of the cashbox 2.

Shutter Arming Mechanism

As discussed above, the cashbox 2 includes a shutter arming mechanism 22 that ensures the shutter 1O is only able to open at the appropriate times in the functional cycle of the cashbox so as to meet the required security of the overall system. At the core of the shutter arming mechanism is a rotating first latch 52 shown in FIG. 5. The first latch 52 serves to prevent drive shaft 30 from rotating (and consequently shutter 10 from opening) when the cashbox 2 has bills inside and is to be removed from the chassis. The first latch 52 includes arming flag 51, arming stop 51A, second latch interaction lever 53, locking bar interaction lever 54 and first latch spring 55. The first latch 52 rotates about a pivot such that arming stop 51A can move in front of a wall 31 attached to the drive shaft 30, if the drive shaft 30 has been rotated to the shutter closed position (see FIG. 4A). The arming stop 51A blocks wall 31 (see reference number 49 in FIG. 4A) and subsequently can prevent drive shaft 30 from rotating back to the open position such that the shutter 10 is locked in the closed position. This may be useful since it prevents access to bills contained within the cashbox through aperture 9 when the cashbox is not installed in the chassis. When the arming stop 51A of latch 52 is rotated into a position that can block wall 31, the first latch 52 is considered to be in a "locking" position. When arming stop 51A of latch 52 is rotated away from wall 3l, the first latch 52 is considered to be in a "free" position. The drive shaft 30 may then rotate from an opened shutter position to a closed shutter position without causing the shutter 10 to lock in the closed position. The arming flag 51 indicates the arming state of the shutter arming mechanism 22 through aperture 20 of the cashbox 2 (see FIG. 1). Preferably, upon installing an empty cashbox 2 in the chamber of the main chassis, the first latch 52 is in the "free" state. The "free" state of latch 52 is not initially altered by the insertion of cashbox 2 into the chassis. This allows a customer to change cashboxes or to have one or more failed attempts at insertion without the need to take the cashbox back to a cash room so as to unlock the shutter 10. The first latch 52 can be balanced such that its center of gravity occurs near the axis of rotation of the latch 52. This may reduce the reduce the possibility of the first latch 52 accidentally rotating to a "free" position if the cashbox 2 is shaken or agitated by external forces.

A second latch 56 in the shutter arming mechanism 22 controls whether or not the first latch 52 is in the "free" or "locking" state. Second latch 56 includes second latch spring 57, second latch head 58, second latch hook 60 and latch stop 63 (see FIG. 5). The second latch 56 may be secured to wall 59 at point 61 from which it can pivot (see FIGS. 6 and 7). Prior to operation of the pressure plate 50, the second latch 56 may be in a position such that a portion of second latch head 58 protrudes beyond wall 59 in a direction perpendicular to the downward path (arrows 6A) of pressure plate 50. Furthermore, the latch stop 63 of second latch 56 is positioned such that it is in front of second latch interaction lever 53 of first latch 52. The presence of latch stop 63 in front of second latch interaction lever 53 prevents first latch 52 from rotating towards the "locking" position. When the second latch head 58 is in this position, the shutter arming mechanism 22 can be considered "armed."

As the pressure plate 50 moves vertically downward upon receiving bills, the plate 50 can push on the protruding portion of second latch head 58. In response to the force of plate 50, the second latch head 58 presses the second latch hook 60 onto the tip of rib 62 on wall 59 and compresses second latch spring 57. The second latch head 58 no longer protrudes beyond wall 59 and the shutter arming mechanism 22 can be considered "disarmed." Furthermore, when the shutter arming mechanism is in the "disarmed" state, the latch stop 63 is no longer in front of second latch interaction lever 53. As a result, first latch spring 55, which is connected to first latch 52, pulls the first latch 52 forward into the "locking" position. As before, if drive shaft 30 is rotated such that shutter 10 closes, the arming stop 51A of first latch 52 can block drive shaft 30 from rotating back to an open shutter position.

Locking Bar and Shutter Retraction

As discussed above, placing the shutter arming mechanism 22 in the "disarmed" state allows first latch 52 to be rotated by first latch spring 55 into the "locking" position. The first latch 52 also may be rotated back into the "free" position by means of a locking bar 74 (see FIGS. 3, 4A and 8) during the unlocking of cashbox 2. The locking bar 74 may be located at the bottom of the cashbox 2 and aligned with external lock 12. The locking bar 74 secures the cashbox by engaging a door lock plate 66 which is fixed to the door 6. It is rotated by means of a cashbox key and a custom 'hasp' fitted to the lock. As the locking bar 74 rotates upon unlocking the cashbox 2, a locking bar arm 82 (see FIG. 9), which extends from locking bar 74, lifts locking bar interaction lever 54 connected to first latch 52. As locking bar interaction lever 54 is lifted, the first latch 52 rotates back to the "free" position.

Figure 7:
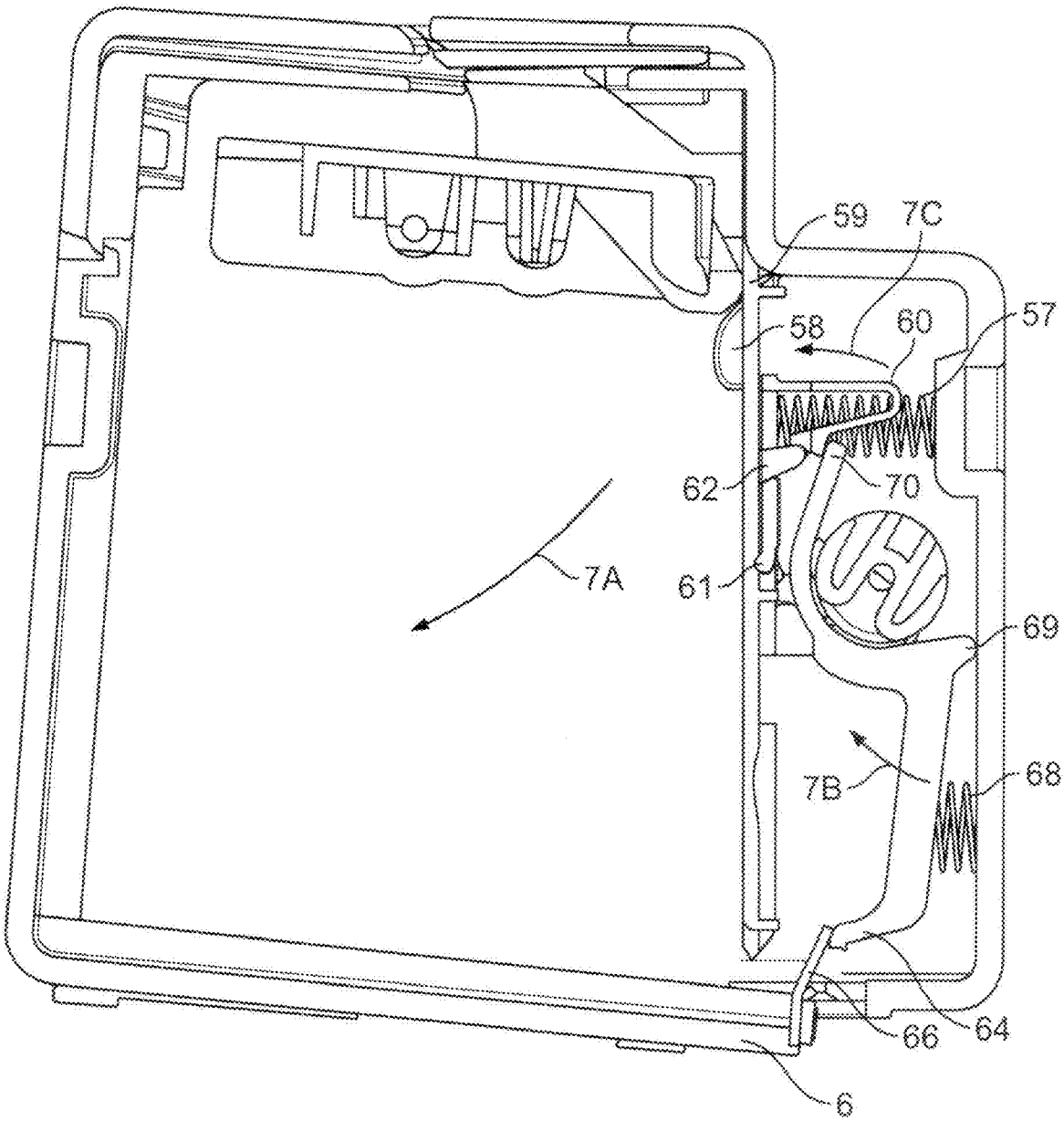
FIG. 7 is an internal side view of a cashbox.

In order to prevent first latch 52 from rotating forward again to the "locking" position, the second latch 56 can be rotated such that the shutter arming mechanism 22 is in the "armed" state. Rotation of second latch 56 into the "armed" state may be achieved by opening door 6. FIG. 7 shows that, as door 6 is opened (arrow 7A), spring 68 forces a lever, also called a pusher 64, to rotate about pivot 69. When the pusher 64 moves (arrow 7B), its upper arm 70 pushes second latch hook 60 off of rib 62. This action allows the second latch head 58 to pivot away from the first latch 52 (arrow 7C), by use of second latch spring 57. As a result, the latch stop 63 is again in front of second latch interaction lever 53 such that first latch 52 may not rotate into the "locking" position and the shutter arming mechanism 22 is in the "armed" state. In addition, the pusher 64 pushes against lock plate 66 to assist in opening door 6. This provides a visual indicator to users that the cashbox 2 is unlocked, so that, after emptying the cashbox 2, the users do not inadvertently send the cashbox 2 back out to a bill handling system.

Figure 8:
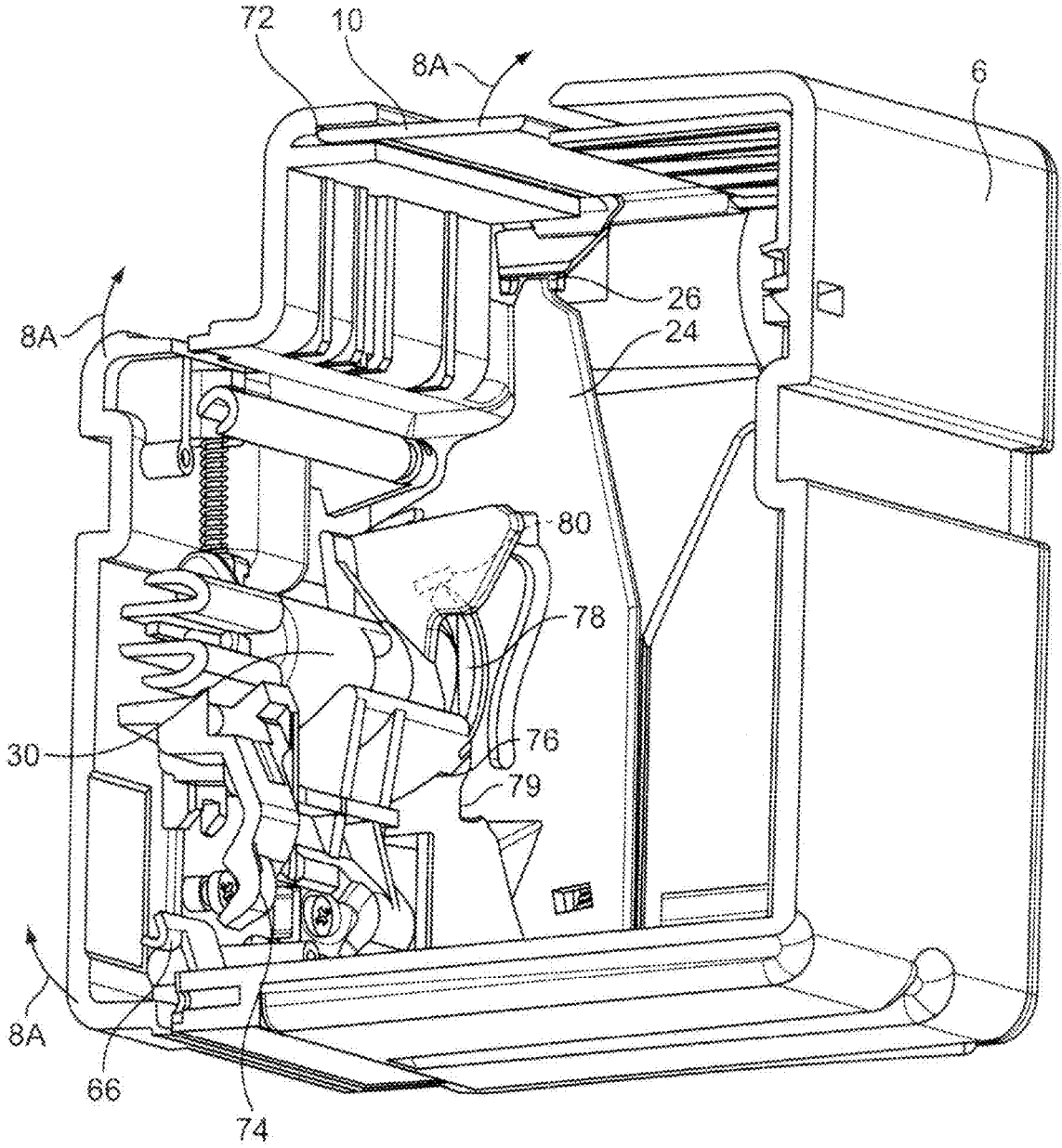
FIG. 8 is an internal view of a cashbox.
Figure 9:
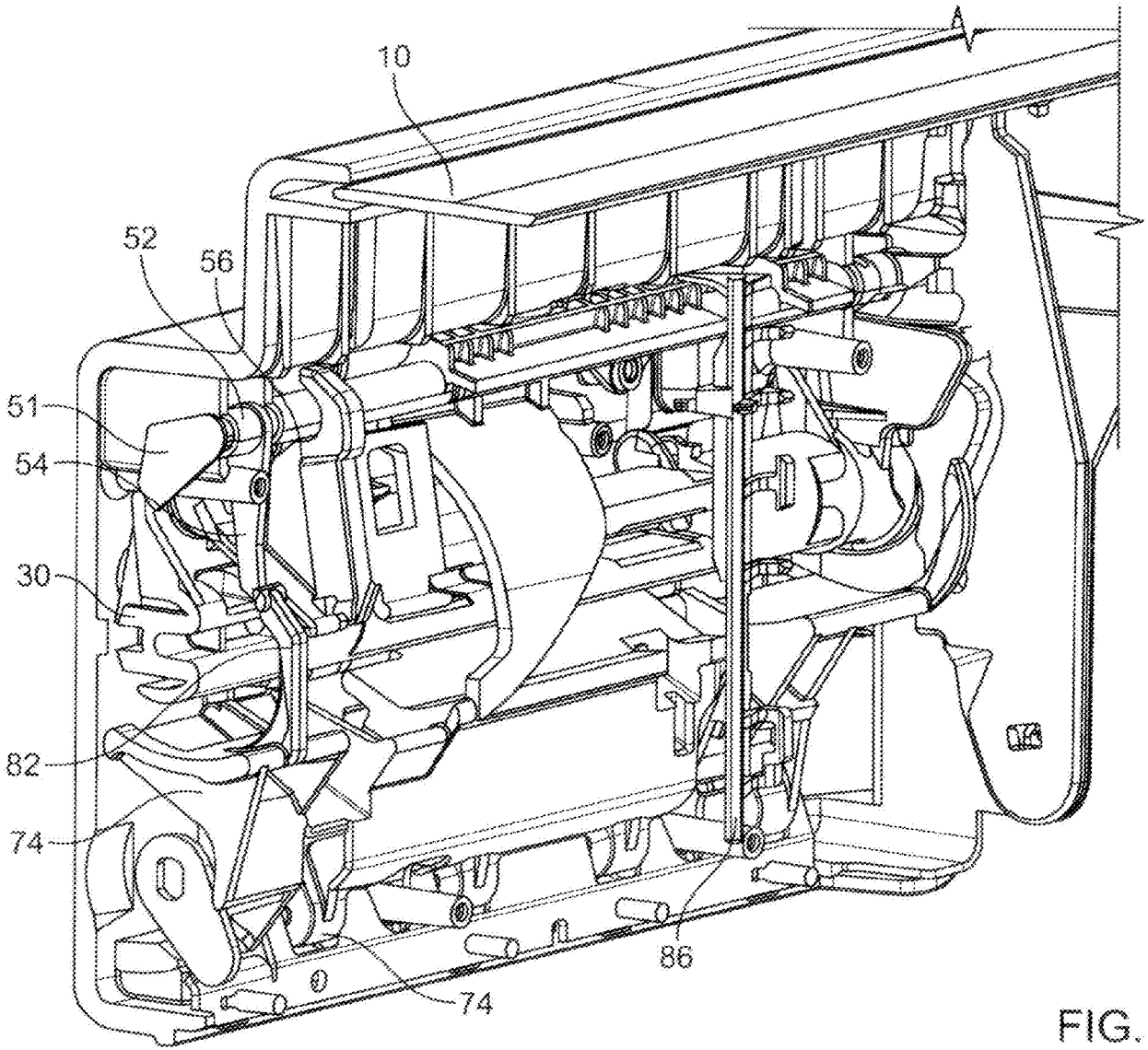
FIG. 9 is an internal view of a cashbox.

In addition to forcing first latch 52 into the "free" position, locking bar 74 may also be used to retract shutter 10 clear of door 6 while a user opens cashbox 2. An example of the shutter retracted position is shown in FIG. 8, in which shutter 10 is retracted into recess 72 of the cashbox molding. Due to the proximity between the shutter 10 and door 6, the shutter 10 needs to be retracted in this manner so that the shutter 10 may clear the door 6 when opening the cashbox 2. As locking bar 74 rotates away from a locked position, a locking bar stop 76 attached to locking bar 74 moves in an upward direction away from a link stop 79. This causes locking arm 78 to rotate against a cam face 80 on the outer surface of link 24. The rotation of locking arm 78 against cam face 80 forces link tip 26 to move shutter 10 into recess 72 such that the cashbox door 6 can be opened without catching shutter 10.

Cashbox Capacity Indicator

Figure 10:
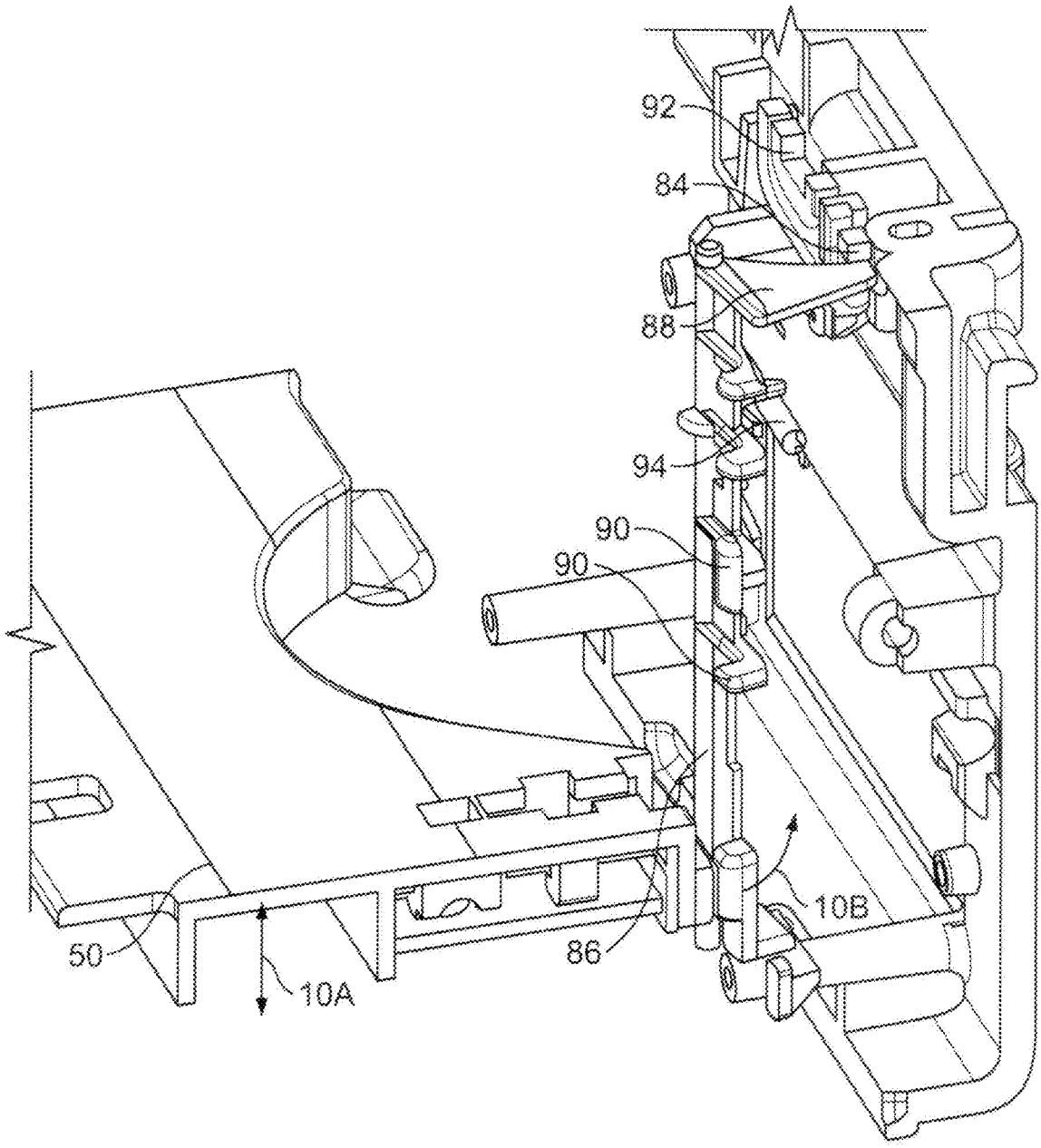
FIG. 10 shows internal cashbox components used in detecting a capacity of a cashbox.

The cashbox 2 can also include a capacity indicator that enables detection of filling levels of the cashbox cassette. In particular, the capacity indicator may allow the bill handling system to detect whether the cashbox 2 is full, half-full or partially full of bills depending on specified settings. The capacity indicator operates using an optical system whereby a first light beam from the chassis is directed towards window 16 on a side of the cashbox 2. Light passes through the window 16 and towards a 'u'-shaped prism 84 (see FIG. 10) contained within the cashbox 2. The first light beam travels through the prism 84 by means of refraction or reflection and exits the cashbox 2 through window 16 towards light sensors contained in the chassis. Preferably, the prism 84 is aligned with the light sensors after the cashbox 2 has been inserted into the chamber.

A rotating arm 86 that includes a flag 88 and an arrangement of paddles 90 along the its length may be located adjacent to the prism 84. As bills are inserted into the cashbox 2, the pressure plate 50 is forced downwards such that a cam (not shown) attached to plate 50 pushes the paddles 90 in sequence and thereby rotates the arm 86. With each rotation of the arm 86 (see arrow 10B), the flag 88 moves through a gap in prism 84 and interrupts the transmission of the first light beam creating light pulses. A return spring 94 forces the arm 86 back to its original position after the pressure plate 50 passes the paddle 90. The paddles 90 may also be pushed by the cam during upward strokes of the plate 50 as well (see arrows 10A in FIG. 10). In an alternative embodiment, the cams may be replaced by a slider (not shown) that slides horizontally in and out of the pressure plate 50. The slider may extend beyond the edge of the pressure plate such that it is depressed into the plate as it comes into contact with paddle 90. The slider may be spring loaded such that it returns to its original position after passing paddle 90.

The changes in the first light beam intensity are sensed by the light sensors. A processor contained within the chassis may execute a set of instructions based on the detected light signals to determine the number of bills present in the cashbox 2. The pattern of the paddles 90 may be designed so that a unique set of rotations of the arm is produced for each position of the pressure plate 50. The lengths or spacing of the paddles 90 may be varied to provide a unique set of rotations corresponding to the various positions of the pressure plate 50. In some implementations, the paddles 90 may be designed for use with a standard capacity cashbox that holds, for example, 600 bills. Alternatively, the paddles may be designed for use with a high capacity cashbox that holds, for example, 1200 bills.

A second light beam directed to a second prism 92 located in the cashbox is also deflected out of the cashbox 2 towards a second light sensor. The second prism 92 is used to determine the presence of the cashbox 2 in the bill handling system.

Interface Peg

Figure 11:
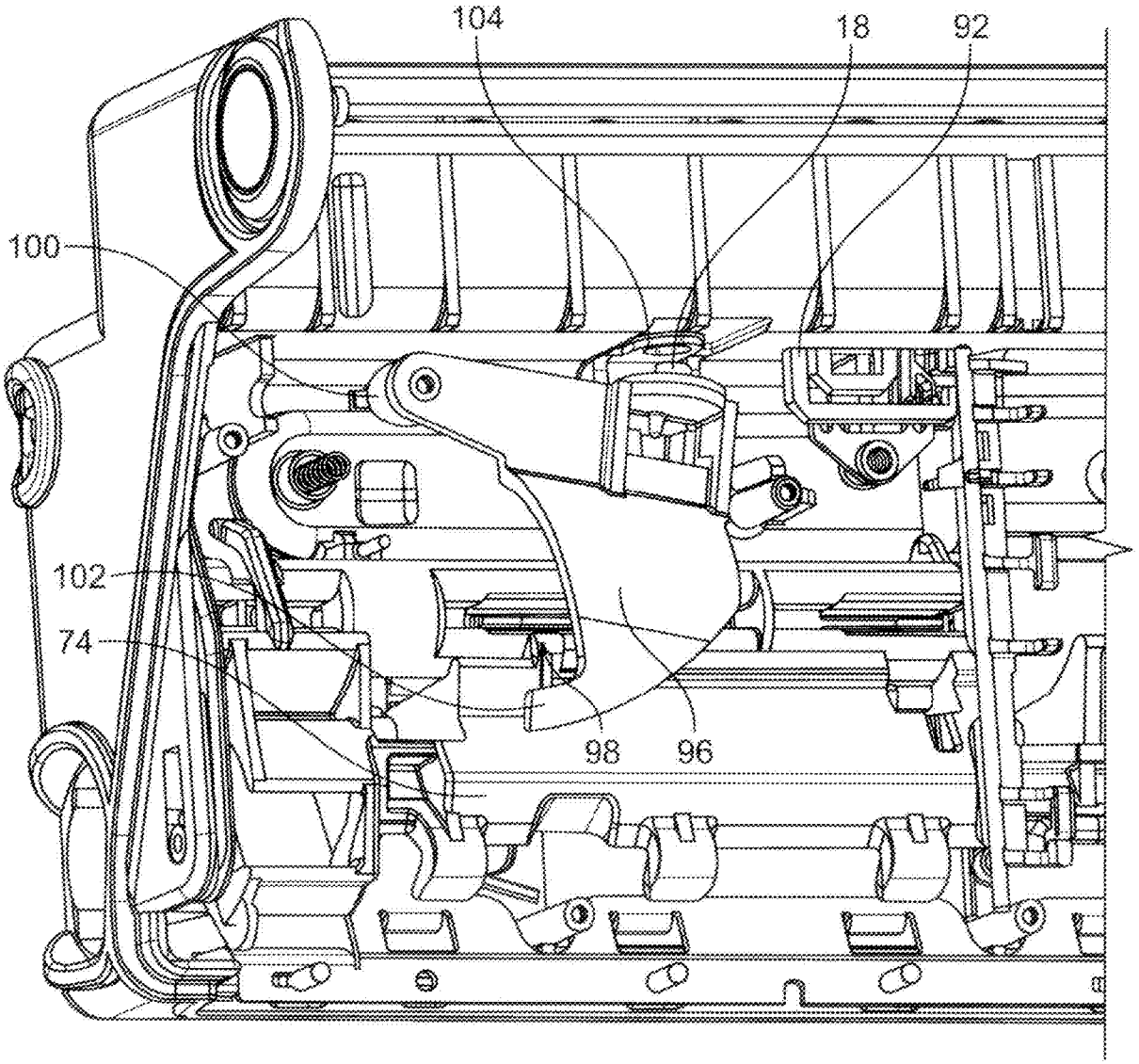
FIG. 11 shows a section view of a cashbox.

FIG. 11 is a section view of cashbox 2 that includes components for operating the interface peg 18. The interface peg 18 is provided on an interlock lever 96 that rotates about pivot 100 connected to the cashbox 2. When the locking bar 74 is locked, a locking bar stop rib 102 formed on the locking bar 74 engages an interlock stop arm 102 such that the lever 96 positions interface peg 18 through aperture 104 and thus securing the peg 18. As locking bar 74 is unlocked, the locking bar stop rib 102 no longer engages interlock stop arm 102 and the lever 96 is allowed to rotate to a position shown in FIG. 11 such that the interface peg 18 is not secured through aperture 104. As a result, a pin from the bill acceptor module 7 used to probe peg 18 may extend downward towards the aperture 104, unlocking the bill acceptor module 7.

A number of embodiments of the invention have been described. Nevertheless, it will be understood that various modifications may be made without departing from the spirit and scope of the invention. Other implementations are within the scope of the claims.

What is claimed is:

1. A bill storage cassette adapted to be inserted into or removed from a chassis, the cassette comprising:

a shutter;

a link to engage the shutter; and a helicoidal drive shaft to engage the link, wherein the shutter is adapted to open or close as the drive shaft is actuated by an actuator fixed within the chassis, and wherein the drive shaft is adapted to provide a pulling action as the cassette is inserted into the chassis or a pushing action as the cassette is removed from the chassis.

2. The bill storage cassette according to claim 1 wherein the shutter is adapted to open automatically as the cassette is inserted into the chassis.

3. The bill storage cassette according to claim 1 wherein the shutter is adapted to close automatically as the cassette is removed from the chassis.

4. The bill storage cassette according to claim 1 wherein the shutter is adapted to open or close an aperture for receiving bills into the cassette.

5. The bill storage cassette according to claim 1 further comprising a pressure plate and a shutter arming mechanism to be engaged by the pressure plate, wherein the shutter arming mechanism is armed by opening a door of the cassette and disarmed by a first operation of the pressure plate.

6. The bill storage cassette according to claim 5 further comprising an indicator on a face of the cassette wherein the indicator indicates an arming state of the shutter arming mechanism.

7. The bill storage cassette according to claim 1 further comprising a locking bar to lock the cassette, wherein the locking bar is arranged to engage the link and wherein the shutter is adapted to be placed in a partially retracted state by unlocking the locking bar.

8. The bill storage cassette according to claim 1 further comprising a recess in an interior surface of the cassette to prevent the shutter from opening when a tip of the link is in the recess.

9. The bill storage cassette according to claim 8 wherein the recess is substantially perpendicular to a plane of horizontal movement of the shutter.

10. The bill storage cassette according to claim 1 further comprising a stop strut to prevent the shutter from opening, wherein movement of the link in a direction of the stop strut, when the shutter is closed, is prevented by the stop strut.

11. The bill storage cassette according to claim 1 further comprising a rotating lever to assist opening the cassette.

12. The bill storage cassette according to claim 1 further comprising a second link to engage the shutter, wherein the helicoidal drive shaft engages the second link and further wherein the links are pivoted.

13. The bill storage cassette according to claim 1 further comprising:

a pressure plate;

a prism;

a rotating arm having a protrusion and paddles on the arm; and a cam on the pressure plate to engage the paddles of the rotating arm, as the pressure plate moves in the cassette, such that the protrusion is rotated into a position that blocks light from a light source passing through the prism.

14. The bill storage cassette according to claim 13, wherein the protrusion rotates back to an original position, when the cam on the pressure plate moves past the paddle, such that the protrusion does not block the light passing through the prism.

15. The bill storage cassette according to claim 13, wherein the positions of the paddles on the rotating arm indicate different quantities of bills in the bill storage cassette.

16. The bill storage cassette according to claim 1 further comprising a lock to lock a door of the cassette, wherein the lock is retained by a lock bracket.

17. The bill storage cassette according to claim 1 further comprising a folding handle.

18. The bill storage cassette according to claim 5 wherein the shutter is adapted to open or close an aperture for receiving bills into the cassette.

19. The bill storage cassette according to claim 6 wherein the shutter is adapted to open or close an aperture for receiving bills into the cassette.

20. A bill storage cassette adapted to be inserted into or removed from a chassis, the cassette comprising:

a shutter;

a pressure plate; and a shutter arming mechanism to engage the pressure plate, adapted to allow the cassette to be repeatedly inserted and removed from the chassis while the shutter arming mechanism remains in an armed state, wherein the shutter arming mechanism prevents the shutter from locking in a closed or open position in the armed state.

21. A bill handling system comprising:

a bill acceptor module for receiving bills;

a locking module to lock the bill acceptor module in the bill handling system;

a cassette to store bills received by the bill acceptor module;

a pin on the locking module; and a retractable peg on the cassette, wherein the bill acceptor module is unlockable and removable from the bill handling system by extension of the pin into a void created when the peg is in a retracted position.

22. A bill handling system according to claim 21 further comprising a door lock mechanism to fix the peg so that it cannot be depressed by the pin.

23. A system to estimate the filling level of a cassette for storing bills and the like, the system comprising:

a pressure plate to support bills in the cassette;

a sensor arrangement to detect a signal change in response to movement of the pressure plate as bills are stored in the cassette; and a rotating arm having a protrusion, wherein the rotating arm comprises a plurality of paddles adapted to be engaged by the pressure plate, wherein a position of each paddle along the arm corresponds to a different position of the pressure plate and wherein the system is arranged so that when the pressure plate engages at least one of the paddles, the arm rotates such that the protrusion generates a signal change in the sensor arrangement.

24. The system according to claim 23 wherein the sensor arrangement comprises:

a light source to produce a light beam and a sensor to detect the light beam, wherein the signal change is generated by at least partial interception of the light beam by the protrusion.

25. The system according to claim 24 wherein the arm rotates back to an original position, when the pressure plate no longer engages the paddle, such that the protrusion does not intercept the light beam.

26. The system of claim 24 wherein the paddles are distributed along a length of the arm to identify a position at which the cassette is partially-full.

27. The system of claim 24 wherein the paddles are distributed along a length of the arm to identify a position at which the cassette is completely full.

28. A bill handling system comprising:

a chassis;

a bill acceptor module to receive bills, wherein the bill acceptor module is attached to the chassis;

a cassette to store bills, wherein the cassette is disposed in the chassis and wherein the cassette comprises a shutter;

an actuator fixed to the chassis;

a link to engage the shutter; and a helicoidal drive shaft to engage the link, wherein the shutter is adapted to open or close as the drive shaft is actuated by the actuator, wherein the drive shaft is adapted to provide a pulling action as the cassette is inserted into the chassis or a pushing action as the cassette is removed from the chassis.

29. The bill handling system according to claim 28 wherein the shutter opens or closes an aperture through which bills are received from the bill acceptor module.

30. The bill handling system according to claim 28 further comprising:

an optical sensor comprising a light source and a detector, wherein a light beam from the light source is detected by the detector when the cassette is disposed in a correct position within the bill handling system.

31. A method of opening or closing a shutter of a bill storage cassette comprising:

actuating a helicoidal drive shaft in the cassette to move a link, wherein motion of the link causes the shutter to open or close an aperture of the cassette, wherein actuation of the drive shaft pulls the cassette into a chassis or pushes the cassette out of the chassis.

32. A method of arming or disarming a shutter arming mechanism of a bill storage cassette comprising:

opening a door of the bill storage cassette such that the shutter arming mechanism is armed, wherein an armed shutter arming mechanism prevents a shutter from locking in a closed or open position; and operating a bill stacker in the cassette such that the shutter arming mechanism is disarmed, wherein a disarmed shutter arming mechanism locks the shutter when the shutter is in a closed position.

33. A method of locking a closed shutter in a bill storage cassette comprising:

operating a pressure plate in the cassette so that a first latch is released from a second latch whereby an arm on the released first latch blocks the motion of a drive shaft used to open the shutter, wherein the pressure plate supports one or more bills placed in the bill storage cassette.

34. A method of closing and locking a shutter in a bill storage cassette comprising:

operating a pressure plate in the cassette so that a first latch is released from a second latch, wherein the pressure plate supports one or more bills placed in the bill storage cassette; and removing the cassette from a chassis such that an actuator fixed in the chassis rotates a drive shaft, wherein rotation of the drive shaft closes the shutter and further wherein an arm of the first latch prevents the drive shaft from rotating back to a previous position.

35. A method of operating a bill storage cassette comprising:

inserting the cassette into a chassis;

actuating a drive shaft in the cassette during insertion to move a link, wherein motion of the link causes a shutter to open;

operating a pressure plate in the cassette such that a shutter arming mechanism is disarmed, wherein the pressure plate supports one or more bills placed in the bill storage cassette;

removing the cassette from the chassis;

actuating the drive shaft in the cassette during removal to move the link, wherein motion of the link causes the shutter to close; and unlocking and opening a door of the cassette, wherein unlocking and opening the door re-arms the shutter arming mechanism.

36. The method of operating a bill storage cassette according to claim 35 wherein disarming the shutter arming mechanism comprises pushing on a second latch with a cam of the pressure plate such that the second latch is placed on a rib in the cassette and a first latch is released from an arm of the second latch.

37. The method of operating a bill storage cassette according to claim 35 wherein the shutter is retracted into an internal recess of the cassette when the door is unlocked.

38. The method of operating a bill storage cassette according to claim 35 wherein re-arming the shutter arming mechanism comprises pushing a second latch off of a rib in the cassette such that an arm of the second latch blocks rotation of a first latch.

39. The method of operating a bill storage cassette according to claim 35 wherein actuating the drive shaft during insertion pulls the cassette into the chassis and actuating the drive shaft during removal pushes the cassette out of the chassis.

40. A method of determining a fill-level of a bill storage cassette comprising:

directing light towards a conduit in the bill storage cassette, wherein the conduit guides the light towards a light sensor;

operating a bill stacking mechanism in the cassette so that a protrusion in the bill storage cassette rotates so as to at least partially block a path of the light in the conduit and produce a change in light intensity incident on the sensor each time the bill stacking mechanism engages at least one of a plurality of extensions on a rotatable arm;

counting a number of light pulses incident on the sensor, wherein the light pulses are produced by the protrusion at least partially blocking the light path; and determining, based on the number of pulses, a fill-level of the bill storage cassette.

* * * * *